US005647795A

United States Patent [19]

Stanton

[11] Patent Number: 5,647,795

[45] Date of Patent: Jul. 15, 1997

[54] PORTABLE COMPUTERIZED PARI-MUTUEL SPORTS ENTERTAINMENT SYSTEM

[76] Inventor: Robert P. Stanton, 2633 Bluff Ridge Dr., St. Louis, Mo. 63129

[21] Appl. No.: 321,137

[22] Filed: Oct. 11, 1994

[51] Int. Cl.[6] ..... A63F 9/24

[52] U.S. Cl. ..... 463/1; 364/412

[58] Field of Search ..... 463/1, 9, 16, 40; 364/412, 410

[56] References Cited

U.S. PATENT DOCUMENTS 4,592,546 6/1986 Fascenda et al. .
5,073,931 12/1991 Audebert et al. .
5,213,337 5/1993 Sherman .
5,283,734 2/1994 Von Kohorn .
5,343,239 8/1994 Lappington et al. .
5,411,258 5/1995 Wilsen et al. .
5,462,275 10/1995 Lowe et al. .
5,476,259 12/1995 Weingardt .

*Primary Examiner*—Mark S. Graham
*Assistant Examiner*—Michael O'Neill
*Attorney, Agent, or Firm*—Polster, Lieder, Woodruff & Luccesi, L.C.

[57] ABSTRACT

A portable computerized pari-mutuel sport system which includes a television, a video cassette recorder, a computer, a keypad, a receipt printer, and a computer program which controls the computer and, if desired, the video cassette recorder so that as betting continues, the betting information is conveyed to the computer where the odds are recalculated and displayed on the television.

8 Claims, 1 Drawing Sheet

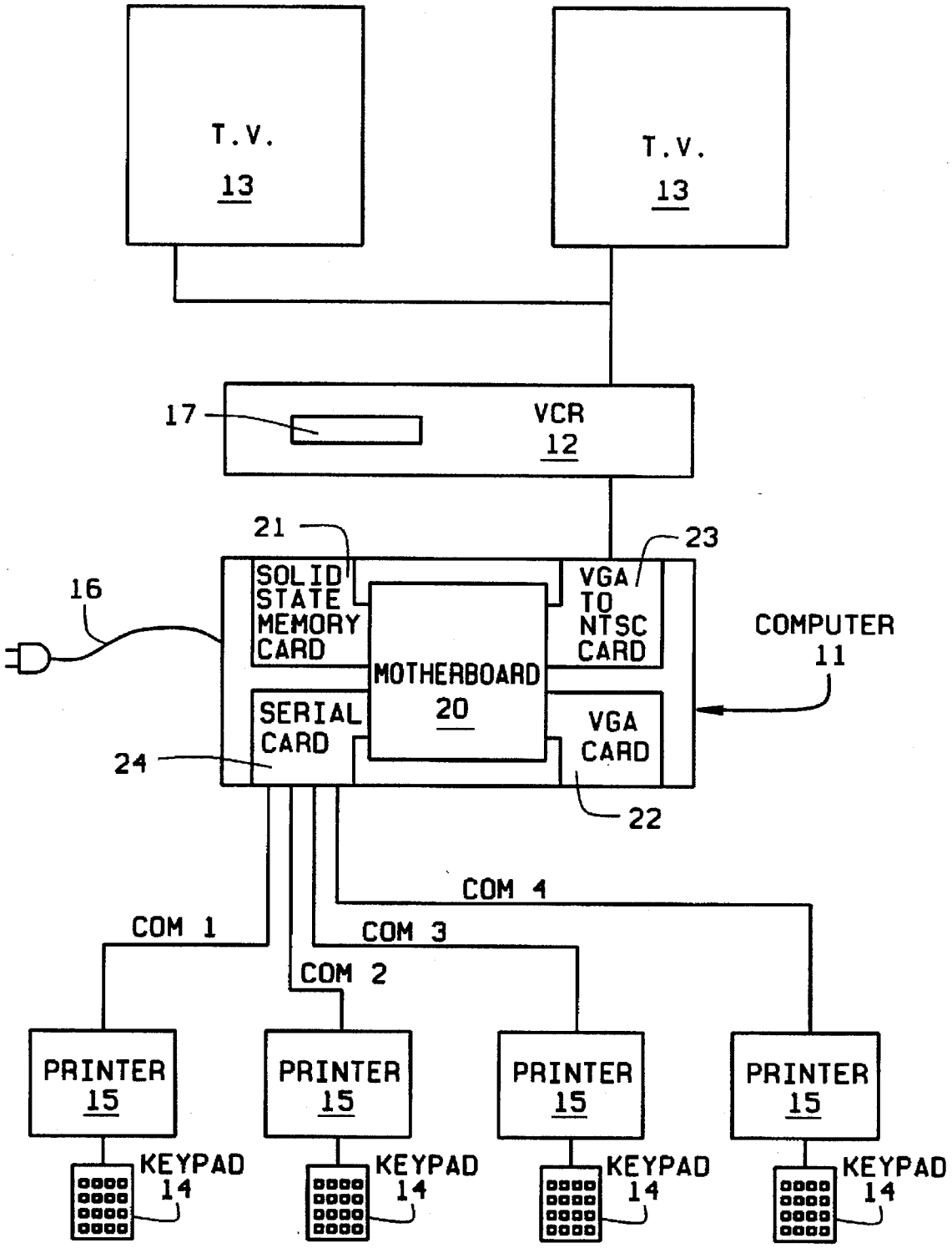
T.V.
13
T.V.
13
17
VCR
12
21
23
16
SOLID STATE MEMORY CARD
MOTHERBOARD
20
VGA TO NTSC CARD
COMPUTER
11
SERIAL CARD
VGA CARD
24
22
COM 4
COM 1
COM 3
COM 2
PRINTER
15
PRINTER
15
PRINTER
15
PRINTER
15
KEYPAD
14
KEYPAD
14
KEYPAD
14
KEYPAD
14

PORTABLE COMPUTERIZED PARI-MUTUEL SPORTS ENTERTAINMENT SYSTEM

BACKGROUND OF THE INVENTION

This invention relates to a portable apparatus for off-site betting on sport events. In particular, it is designed to provide a method and apparatus for utilization by large groups, i.e., more than about 50 people, to participate in the fun and excitement of an event such as a horse race, without being at the event itself. Such activities are used as fund raising events for charitable organizations, for fun at a resort, or at a gambling casino, or corporate entertainment.

This system is completely portable and can be set up in minutes. The system is simple to operate and only a few minutes of training are necessary for the operators. No computer experience is necessary. Also, because of the system's portability and simplicity, it is well suited as a rental unit to any organization wishing to conduct a "Night At The Races". About the only equipment required by the sponsoring organization is a television set and a video cassette recorder (VCR).

Thus, one of the principal objects of the invention is to provide a method and equipment for operating a betting game away from the site of the event using a computer, computer program for operating the computer, computer television interface, a keypad for keying betting information into the computer, a printer for printing receipts for the bets keyed into the computer, a video cassette recorder (VCR) for playing a tape of a sport event, and a television set for displaying the event and the odds and/or payoffs on the event. These and other objects and advantages will become apparent hereinafter.

SUMMARY OF THE INVENTION

The invention comprises a system and method for displaying a sport event at an off-site location and providing a betting apparatus for displaying odds and/or payoffs, accepting and acknowledging bets, recalculating the odds and/or payoffs based on the new bets, displaying the new odds and/or payoffs, terminating the betting prior to inception of the sport event, calculating and displaying the final payoffs, and displaying the sport event.

DESCRIPTION OF THE DRAWING

The drawing is a schematic representation of the equipment and process of one embodiment of the present invention.

DETAILED DESCRIPTION

The drawing shows a schematic representation of one embodiment of the device which includes a computer 11, a video cassette recorder (VCR) 12, one or more television sets 13, and a series of keypads 14 and associated printers 15. The computer 11 is connected by a conductor 16 to a conventional A.C. power source. Used with the system is a video tape 17 of a sport event.

The computer 11 includes a motherboard 20 such as a 386SX, 40 Mhz, with 1 Meg of memory. The computer 11 also has a solid state memory card 21, a VGA card 22, a VGA to NTSC card 23, and one or more serial cards. Each of the keypads and printers 15 are connected to the serial card 24. VGA is an acronym for "video graphics array" and NTSC is an acronym for "National Television Standards Committee".

The computer 11 is operated by a computer program so that as betting is taking place and bets are keyed into the computer 11, the information is compiled by the computer 11, the odds and/or payoffs are refigured, and the new odds and/or payoffs are continually updated on the television screens 13 by the computer 11.

When the bets are keyed into the computer 11, a receipt is printed by the printers 15 and given to the player.

The ticket printer 15 can be a serial receipt printer, such as a Citizen 3530, and the keypad 14 can be a serial keypad, such as made by Alps.

The computer program which operates the computer 11, in addition to recalculating odds on bet placement, is unique and is designed to permit the operation of many receipt printers and keypads at one time. This is the key to handling a large crowd in a short amount of time. The software is also unique in that it is designed to prompt the operator, via printouts on a designated ticket printer, on how to operate the system. In this way, a person with virtually no experience can competently operate the system.

The video cassette recorder 12 preferably is operated manually, if desired, but the system can be designed so that the computer automatically controls the video cassette recorder 12.

In one embodiment, the device operates as follows:

1. Two tables are set up in the area where the game is to be played away from the site of the event to be bet on, a betting table and a cashier's table. The event can be either real time or non-real time.

2. The system is removed from a container, set on the betting table, and plugged in.

3. The television sets are hooked up to the system with ordinary video cable.

4. The players are issued play money upon entering the hall.

5. The system is turned on.

6. The video tape is placed into the video cassette recorder (VCR) which is started manually or by the computer. If the event is a horse race, the parade of the horses is shown for the next race on the television.

7. After the parade of horses is shown, the VCR is shut off manually or by the computer. The computer then displays an announcement that the betting windows are open.

8. The players simply walk up to the betting table and place bets on the horse of their choice. The worker at the betting table presses the number of a chosen horse on the keypad. Receipts are then printed out and given to the player for the bets made.

9. As the bets are entered into the computer via the keypads, the computer updates the odds and/or payoffs on each horse as a bet is entered and displays the new odds and/or payoffs on the television. The minutes until post time are also displayed on the television.

10. When the betting time elapses, a special key is depressed to terminate betting. The final odds are then displayed on the television.

11. The video cassette recorder is then started manually or by the computer. The race then is shown on the television by the VCR. At the end of the race, the workers enter the numbers of the win, place, and show horses into the computer through the keypad and the payoffs are displayed on the televisions.

12. The players holding winning receipts then go to the cashier's table to collect their winnings.

13. Steps 6 thru 12 are repeated for however many races are run. Typically, with 15 minutes per race, an evening of 10 races would take about 2 ½ hours.

While there are horse racing games available, they are manually operated, and to a large extent are quite unrealistic. Using currently available horse race games, payoffs are calculated only at the conclusion of betting so the player knows nothing about the odds and/or payoffs when he places his bet. My system also provides racing programs for the players which have actual statistics about the horses and actual initial odds. Only the names of the horses have been changed. No present game provides recalculated payoffs based on the betting. Using this system, the player is as close to being at the track as possible without actually being there.

Following is a listing of the advantages of the computerized video horse racing system:

1. Much more realistic due to the odds and/or payoffs being displayed real time.

2. Less chance of error in figuring odds and payoffs.

3. Greater control over timing of the event.

4. Fewer people required to run the event.

5. The whole event runs much smoother since the computer is in control and does most of the work.

6. Computerization makes more complex betting, such as win, place, and show bets, daily doubles, quinellas, etc., easier.

7. The system guides the operator through the necessary steps, thus minimizing the training required.

8. Video tapes are easier and better than movies.

While the invention has been described as related to a video tape of a horse race, the sport event does not have to be a thoroughbred race horse event. It can be a harness race, dog race, turtle race, or any other type of race. Also, snippets of a sporting event, such as a basketball game, football game, etc., could be shown with betting taking place on the outcome.

Also, instead of video tapes of real races, other representations can be used, such as movie film of races, CD-ROM technology, animated races, or even real time races taking place on T.V. or at the location.

This invention is intended to cover all changes and modifications of the example of the invention herein chosen for purposes of the disclosure which do not constitute departures from the spirit and scope of the invention.

What is claimed is:

1. A portable pari-mutuel system for off-site betting on sports events comprising a) at least one television monitor, b) a video cassette recorder operatively connected to said television monitor whereby a video tape of a prerecorded sporting event run through said video cassette recorder is displayed on said television monitor, c) at least one receipt printer, d) at least one keypad operatively connected to said receipt printer for accepting keyed-in bets, e) a computer operatively connected to the keypad and to said television monitor including a computer program for accepting betting information from the keypads and recalculating the odds or payoffs, displaying the new odds or payoffs on the television monitor, and causing the receipt printer to issue a receipt for the keyed-in bet, and computer-television interface to display computer generated information on said television monitor.

2. The system of claim 1 including hardware and software for controlling the video cassette recorder.

3. The system of claim 1 including a video tape of a sport event.

4. The system of claim 1, wherein the computer program prompts or guides the operator through each step of the process.

5. A method of off-site betting on a sport event including the steps of a) programming a computer to accept betting information from a remote key, operate a printer to issue a receipt for keyed-in bets, utilize said betting information to recalculate the odds or payoffs on the event and display the recalculated odds or payoffs on a television monitor, b) activating said computer, c) accepting new bets, d) issuing receipts for the new bets, e) adding the new betting information to the computer from the keypad, f) utilizing the new betting information to recalculate the odds or payoffs, g) displaying the new odds or payoffs on the television, h) inactivating the keypad and the bet accepting process, i) activating the video cassette recorder, and k) displaying the sport event on the television.

6. The method of claim 5 wherein the output from the video cassette recorder includes a display on the television screen of the post parade.

7. The method of claim 5 wherein the computer has software which accepts betting information from the keypad, recalculates the odds or payoffs utilizing the initial established odds or payoffs and the additional betting information, and displays the new odds or payoffs on the television screen.

8. The method of claim 5 wherein the computer program operates the video cassette recorder and controls the on-off states of the keypad and printer.

* * * * *